US006220330B1

(12) United States Patent
O'Brien, Jr.

(10) Patent No.: US 6,220,330 B1
(45) Date of Patent: Apr. 24, 2001

(54) CONVEYOR SYSTEM INCORPORATING ARTICLE GUIDE AND POSITIONING ARRANGEMENT FOR A LABELING STATION

(75) Inventor: Terrence E. O'Brien, Jr., Oconomowoc, WI (US)

(73) Assignee: Dorner Mfg. Corp., Hartland, WI (US)

( * ) Notice: Subject to any disclaimer, the term of this patent is extended or adjusted under 35 U.S.C. 154(b) by 0 days.

(21) Appl. No.: 09/164,330

(22) Filed: Oct. 1, 1998

(51) Int. Cl.[7] ..... B65C 9/02; B65C 9/08

(52) U.S. Cl. ..... 156/556; 156/558; 156/566; 156/DIG. 25; 198/626.6; 198/836.1

(58) Field of Search ..... 156/556, 558, 156/566, DIG. 25, DIG. 27; 198/620, 626.6, 836.1, 836.2, 836.3, 719, 721, 728

(56) References Cited

U.S. PATENT DOCUMENTS 2,781,123 * 2/1957 Gueffroy ..... 198/836.3
2,997,156 * 8/1961 Frazier ..... 198/836.3
3,126,309 * 3/1964 Manas et al. ..... 156/DIG. 27
4,201,621 * 5/1980 Crankshaw et al. ..... 156/567
4,239,570 * 12/1980 Kerwin ..... 156/163
4,526,645 * 7/1985 Malthouse et al. ..... 156/350

* cited by examiner

*Primary Examiner*—Richard Crispino
*Assistant Examiner*—Sue A. Purvis
(74) *Attorney, Agent, or Firm*—Andrus, Sceales, Starke & Sawall, LLP

(57) ABSTRACT

An apparatus for applying labels to articles being moved in a single-file along a conveyor assembly by a primary conveyor belt. Articles such as video cassette containers or CD containers are conveyed in an upright singulated fashion along a conveyor assembly. Each individual article enters a labeling station where the article contacts a biasing assembly that includes a biasing belt. The biasing belt exerts a lateral force on the article to press the article into contact with a stationary guide assembly. The biasing belt is operated at substantially the same speed as the primary conveyor belt such that the article is held in contact with the stationary guide assembly as the article moves along the labeling station. A labeling unit applies a label to the article as the article is held in contact with the stationary guide assembly by the biasing belt.

24 Claims, 3 Drawing Sheets

CONVEYOR SYSTEM INCORPORATING ARTICLE GUIDE AND POSITIONING ARRANGEMENT FOR A LABELING STATION

BACKGROUND OF THE INVENTION

Conveying systems are often employed to convey articles through a series of sequential working stations. In certain conveyor systems, a number of different articles are separately stacked in a series of individual dispensers mounted along a moving conveyor. Through operation of a computer program, individual articles are selectively dispensed onto the moving conveyor, and the articles are then conveyed to a location where they can be stacked and packaged for shipment to the customer.

Typically, the articles are generally rectangular and include a pair of relatively wide flat face surfaces and an outer peripheral edge defined by relatively narrow individual side surfaces. The articles are fed by the dispensers onto the conveyor such that one of the face surfaces contacts the conveyor. Downstream from the dispensers, the individual articles are reoriented onto one of their side surfaces and are conveyed through the remaining portion of the conveying system while resting on the side surface. In many conveying systems, a labeling station is positioned downstream from the dispensers such that labels can be applied to the articles before the articles are assembled into stacks. Typically, the labeling station includes at least one labeling unit that applies a label to the article without actually contacting the article.

In past labeling stations included in conveying systems of this type, the article is supported on a conveyor belt as it passes through the labeling station. A pair of stationary guide members are spaced above the conveyor belt to prevent the article from tipping back onto its face surface as the article is conveyed through the labeling station. Typically, these guide members are spaced a predetermined distance greater than the maximum width of the articles being handled by the system, such that articles of different sizes are able to travel through the labeling station.

Since the article is not positively supported as a label is applied, problems exist in using the labeling station to apply labels to articles having different sizes. For example, a VCR tape is much wider than a compact disc container, such that the position of the article with respect to the labeling unit may vary depending on the type of article. This creates difficulties in controlling label application to provide consistent label placement and positive engagement of the label with the surface of article. Therefore, a need exists to provide a labeling station that increases control of the interface between the article and the label applicator as the article passes through the labeling station.

SUMMARY OF THE INVENTION

The present invention is directed to an apparatus for supporting and applying labels to individual articles as the articles are moved in a single-file fashion along a primary conveyor assembly. The plurality of articles, such as video cassette containers, compact disc containers, audio cassette containers, or the like are conveyed in an upright, singulated fashion on a primary conveyor belt which transports the articles through a labeling station. A biasing assembly contained in the labeling station contacts each of the individual articles and forces the article into contact with a stationary guide assembly. The biasing assembly is operated at substantially the same speed as the primary conveyor assembly, such that the article is continuously pressed against the stationary guide assembly as the article moves through the labeling station. A plurality of labeling units are positioned to apply a label to each article as the article is supported against the stationary guide assembly by the biasing assembly. The stationary guide assembly defines an article engagement with the article engagement surface spaced a predetermined distance from each of the labeling units, and the biasing assembly maintains each article in engagement surface as the articles are transported past the labeling units. In this manner, each of the plurality of articles is supported in an identical position relative to the labeling unit.

The biasing assembly of the invention includes a biasing belt that is operated at the same speed as, or at a faster speed than, the primary conveyor belt. The biasing belt is entrained between an upstream roller and a downstream roller and rotates thereabout. The biasing belt includes a continuous backing belt and a plurality of loops extending from the backing belt. The plurality of loops are formed from a continuous strip of material. The continuous strip of material is fixed to the backing belt at a plurality of trough portions each located between adjacent loops. In this manner, the continuous strip of material forms the loops that extend from the backing belt.

The primary conveyor belt supports each of the articles on its side, and moves the articles through the labeling station. The biasing belt is positioned above the primary conveyor belt such that the loops of the biasing belt are spaced slightly inward from the article engagement surface of the stationary guide assembly. Preferably, the distance between the plurality of loops and the article engagement surface is less than the thickness of the thinnest article being handled by the system.

As the biasing belt contacts one of the articles, the individual loops in contact with the article flex inward to deform the original shape of the loop. The flexible loops exert a relatively soft lateral force on the article to press the article toward the article engagement surface of the stationary guide assembly.

The stationary guide assembly preferably includes an upper guide rail and a lower guide rail which are positioned adjacent to the lateral edge of the primary conveyor belt. The upper and lower guide rails are positioned above the primary conveyor belt, and each guide rail defines an article engagement surface generally aligned with the lateral edge of the primary conveyor belt. The flexible loops of the biasing belt exert a force on a second face surface of the article to force a first face surface of the article into contact with the article engagement surfaces of the upper and lower guide rails. Since the biasing belt and the primary conveyor belt are operated at substantially the same speed, the individual loops of the primary conveyor belt continuously force the article into contact with the article engagement surfaces of the upper and lower guide rails as the articles are transported past the labeling units.

As each article passes through the labeling station, the article is continuously pressed against the upper and lower guide rails by the biasing belt. When the article is pressed against the article engagement surfaces of the upper and lower guide rails, the first face surface of the article is always positioned a known distance from the label application of each labeling unit contained within the labeling station, regardless of the thickness of the article. In this manner, the labeling units can accurately and consistently apply a label to each article as it passes through the labeling station.

Therefore, it is an object of the invention to provide a mechanism for applying labels to articles being moved in a single-file fashion along a primary conveyor assembly. It is an additional object of the invention to provide a biasing assembly to exert a force to hold each individual article moving along the primary conveyor assembly in contact with a stationary guide assembly. It is another object of the invention to provide a biasing assembly that positions the article in a known relationship to a labeling unit contained in the labeling station. It is a further object of the invention to provide a biasing belt in the biasing assembly that flexes laterally upon engagement with an article to exert an outward force to hold the article in contact with the stationary guide assembly. It is a further object of the invention to provide a biasing assembly that operates at substantially the same speed as the primary conveyor assembly such that the biasing assembly supports the article as the article moves through the labeling station.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
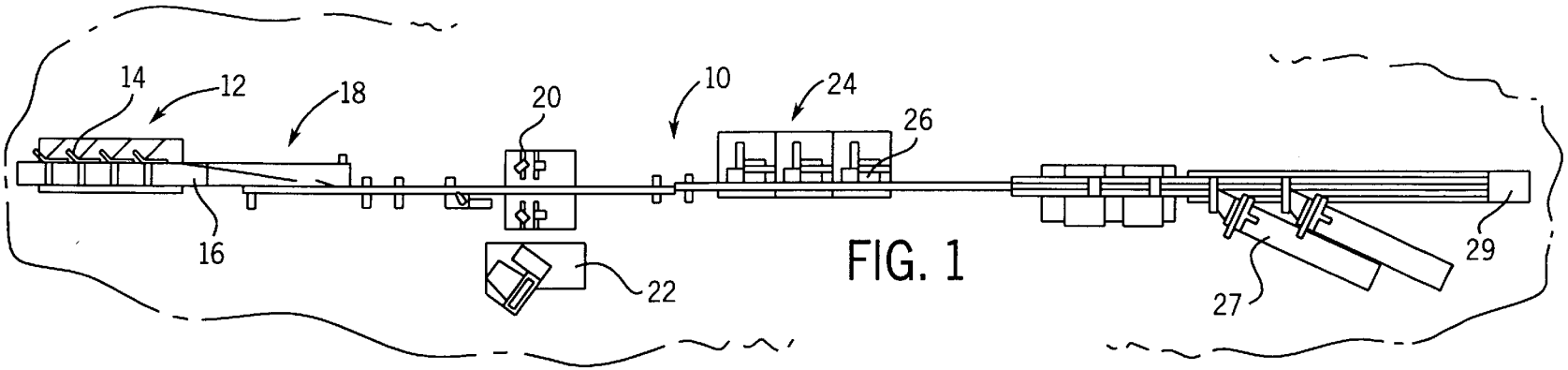
FIG. 1 is a top plan view of an article sorting and conveying system incorporating the label printing and applicating mechanism of the present invention.

FIG. 1 illustrates an article sorting and conveying system 10 that dispenses separately stacked articles and conveys the articles to a location where they can be packaged for shipment. The article sorting and conveying system 10 generally includes a dispensing section 12 that includes a series of dispensers 14 that dispense articles onto an infeed conveyor 16. The dispensing section 12 can include a number of dispensers 14, each of which may contain a different type of article, such as video tapes, compact discs, audio cassettes and the like, or a series of different articles of the same type. The detailed construction of each individual dispenser 14 is shown and described in the commonly owned U.S. Pat. No. 5,586,685, incorporated herein by reference.

The articles are individually dispensed onto the infeed conveyor 16 such that the flat face surface of the article rests upon the infeed conveyor 16. Once dispensed onto the infeed conveyor 16, the articles are moved downstream to a reorientation section 18 where the individual articles are repositioned onto one of their side surfaces. Each of the articles is then transported throughout the remainder of the article sorting and conveying system 10 supported on its side surface.

After each article has passed through the reorientation section 18, the article continues to move downstream and passes through a bar code reader 20 that is able to accurately and quickly identify the article being moved by the article sorting and conveying machine 10. A computer operating station 22 allows an operator to control and monitor the operation of the article sorting and conveying system 10.

Once the individual article has been identified by the bar code reader 20, the article enters a labeling station 24 that can apply various types of labels or stickers to the article moving through the article sorting and conveying system 10. In the embodiment of the invention shown in FIG. 1, the labeling station 24 includes a series of individual labeling units 26 that operate independently to apply a label to each article passing through the labeling station 24.

After leaving the labeling station 24, each individual article is diverted into one of a series of stacker mechanisms 27 depending on the type of article required to form the stack being assembled by each individual stacker mechanism 27. The series of stacker mechanisms 27 allow several individual stacks to be assembled simultaneously. Each of the stacker mechanisms 27 assembles a stack of articles, each of which is resting on its side surface. If none of the stacker mechanisms 27 require the individual article passing along the article sorting and conveying system 10, the article is collected in a storage container 29 positioned at the downstream end of the article sorting and conveying machine 10. In this manner, the article sorting and conveying system 10 is able to simultaneously assemble stacks of different types of articles, and stacks of different articles of the same type, where the articles are intermingled in a continuous, single-file stream. Thus, the article sorting and conveying system 10 significantly increases the flexibility of the stacking operation, since the article sorting and conveying system 10 does not need to be separately configured for each type of article being stacked.

Figure 2:
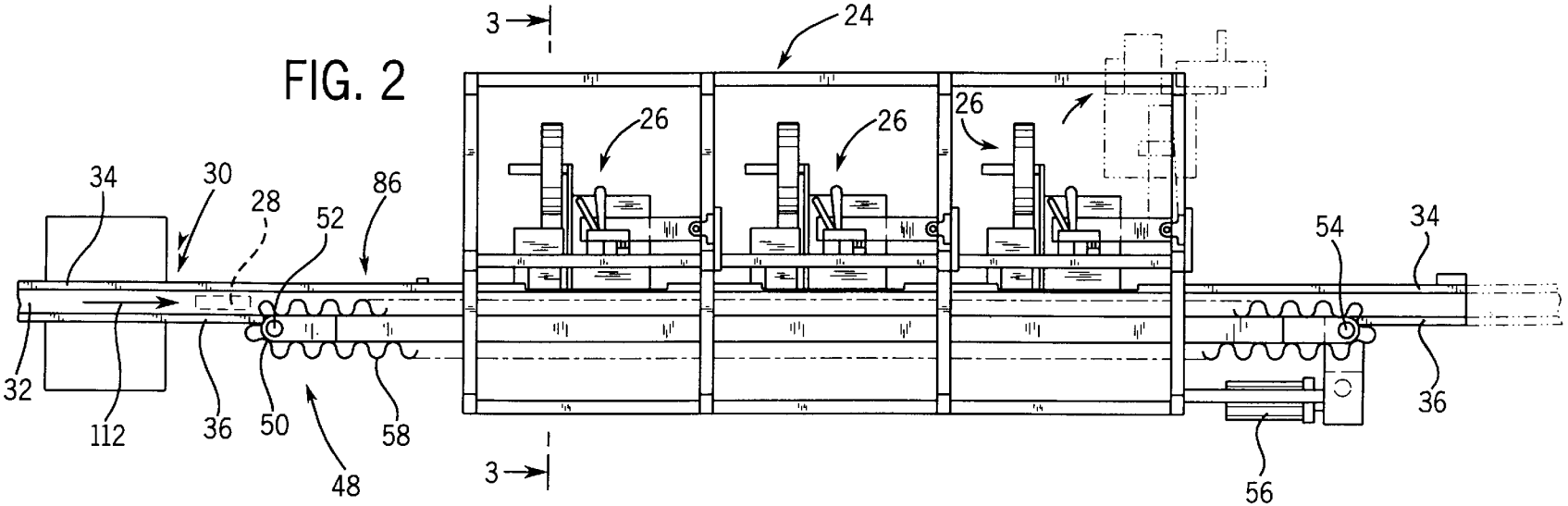
FIG. 2 is an enlarged top plan view of the label printing and applicating mechanism of the present invention as incorporated into the article sorting and conveying system of FIG. 1.

FIG. 2 illustrates the labeling station 24 of the article sorting and conveying system 10. The labeling station 24 receives an article 28 that is traveling along a primary conveyor assembly 30 that includes a primary conveyor belt 32 and a pair of spaced guide members 34 and 36. The guide members 34 and 36 are spaced above the conveyor belt 32 such that the guide members 34 and 36 loosely retain the article 28 to prevent the article 28 from tipping back onto its face surface while the side surface of the article 28 is supported on the conveyor belt 32. Specifically, the guide members 34 and 36 are spaced from each other by a distance sufficient to accommodate articles having different sizes, such as VCR tape containers and compact disc containers.

Figure 3:
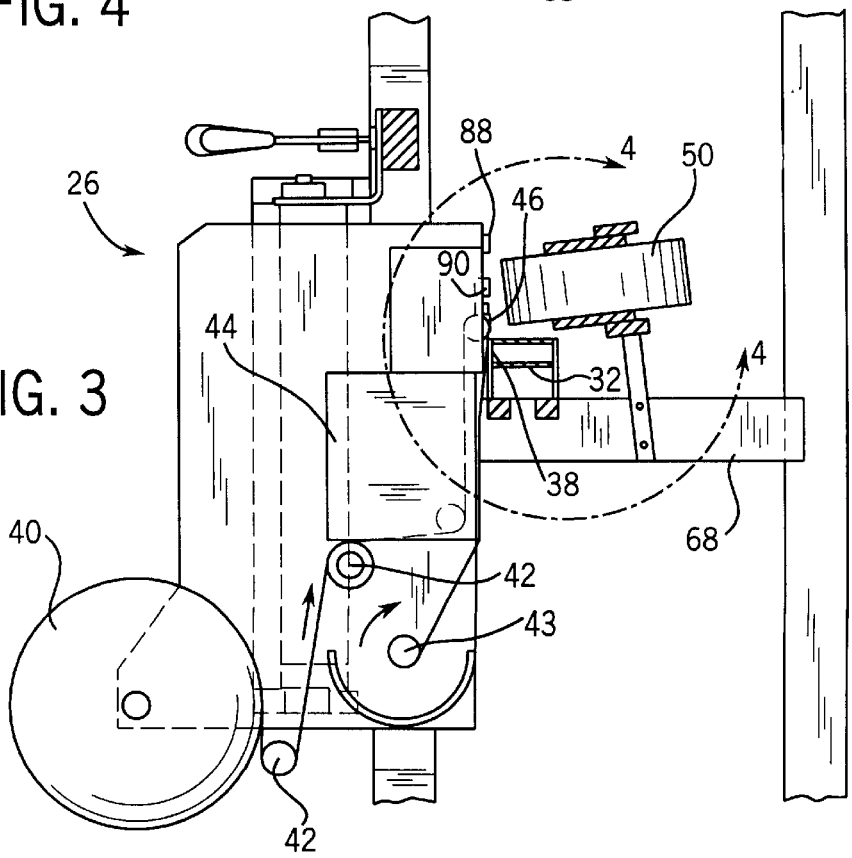
FIG. 3 is a sectional view taken along line 3—3 of FIG. 2 showing a labeling unit and a biasing assembly of the present invention.

The labeling station 24 includes a series of labeling units 26 that are sequentially aligned along one edge of the conveyor belt 32. As can be seen in FIG. 3, the labeling units 26 are positioned adjacent to a lateral edge 38 of the primary conveyor belt 32, such that each labeling unit 26 can apply a label to an article 28 supported on the primary conveyor belt 32. Representatively, the labeling unit 26 is a conventional labeling unit such as is sold by Label-Aire, Inc. of Fullerton, Calif., under Model No. 2138.

Each labeling unit 26 includes a roll 40 of self-adhesive, blank labels. The roll of labels 40 is fed around a pair of rollers 42 and into a printing assembly 44. The printing assembly 44 prints preselected information onto the individual labels. For example, the predetermined information printed by the printing assembly 44 could be the retail price of the article, a tracking or distribution code, or any other information which may vary depending upon the order or retail establishment for which the article 28 is destined. Repersentatively, the printing assembly 44 is a commercially available print engine available from SATO under Model No. 8485S.

Figure 4:
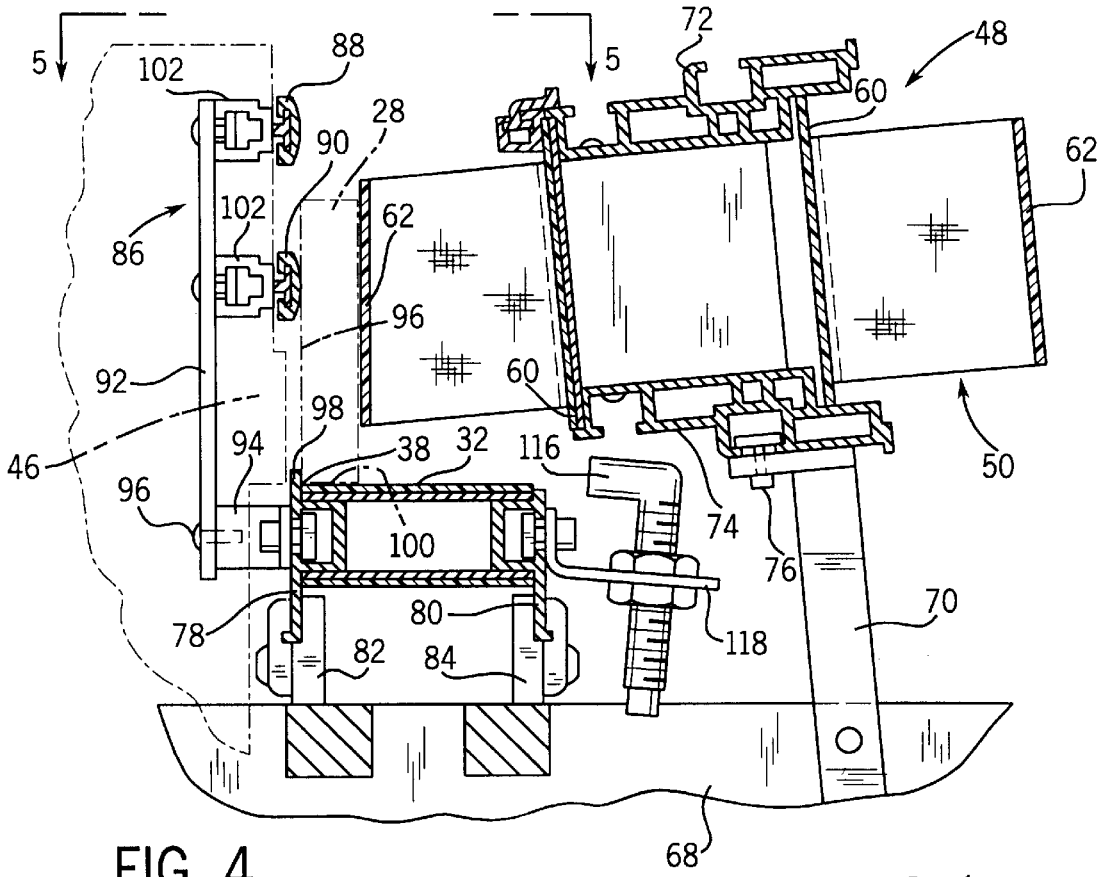
FIG. 4 is a partial sectional view taken along line 4—4 of FIG. 3 showing a biasing belt of the biasing assembly and a stationary guide assembly.

After passing through the printing assembly 44, the label is removed from its backing by a suction device contained on a print head 46. After the label has been removed from the backing, the suction device is moved into a position near the article 28, as shown in FIG. 4. Once near the article 28, the air flow direction in the print head 46 is reversed, such that the supply of air forces the label into contact with the article 28. In this manner, a label can be applied to the article 28 without the print head 46 ever contacting the article 28.

After the label has been removed from the backing, the backing is wound around a wind-up roller 48. In this manner, the roll of labels 40 is printed, applied and disposed of by the labeling unit 26.

As shown in FIG. 2, a series of labeling units 26 are included in the labeling station 24. In prior systems, it was found that the primary conveyor assembly 30 could be operated at a speed faster than the speed a single labeling unit 26 could print and apply a label to each one of the articles. Thus, in a system having only a single labeling unit 26, a bottleneck was created in the article sorting and conveying machine 10 at the labeling unit 26. To eliminate the bottleneck, the series of labeling units 26 are positioned sequentially within the labeling station 24, which allows the primary conveyor assembly 30 to be operated at an optimal speed without causing a bottleneck in the labeling station 24. Each of the labeling units 26 operates in an identical manner and the labeling units 26 can be configured either to print identical or different labels, depending upon the system requirements.

As the article 28 enters into the labeling station 24 on the primary conveyor belt 32, the article 28 contacts a biasing assembly 48. The biasing assembly 48, as shown in FIG. 2, includes a biasing belt 50 that is entrained between an upstream roller 52 and a downstream roller 54. Both the upstream roller 52 and the downstream roller 54 are disposed to rotate about a generally vertical axis. The downstream roller 54 is driven by a motor 56, such that the downstream roller 54 acts as a drive roller to rotate the biasing belt 50 between the upstream roller 52 and the downstream roller 54. In the preferred embodiment of the invention, the motor 56 drives the biasing belt 50 at the same speed as, or at a speed slightly faster than, the speed of the primary conveyor belt 32.

The biasing belt 50 includes a series of loops 58 positioned along the entire length of the biasing belt 50, as shown in FIG. 2. As can best be seen in FIG. 5, each of the loops 58 is formed from a continuous length of material 59 that is fixed to a backing belt 60 at regular intervals to define the plurality of loops 58. In this manner, the backing belt 60 and the continuous length of material 59 forming the loops 58 combine to form the biasing belt 50.

Each of the loops 58 includes an arcuate outer contact surface 62 that is spaced from the lateral edge 38 of the primary conveyor belt 32 when the loop 58 is in a relaxed state and not in contact with an article 28. In the preferred embodiment of the invention, the distance between the arcuate outer contact surface 62 of each loop 58 and the lateral edge 38 of the primary conveyor belt 32 is based on the width of the thinnest of the articles 28 to be handled by system 10, for reasons that will be discussed in greater detail below.

Figure 5:
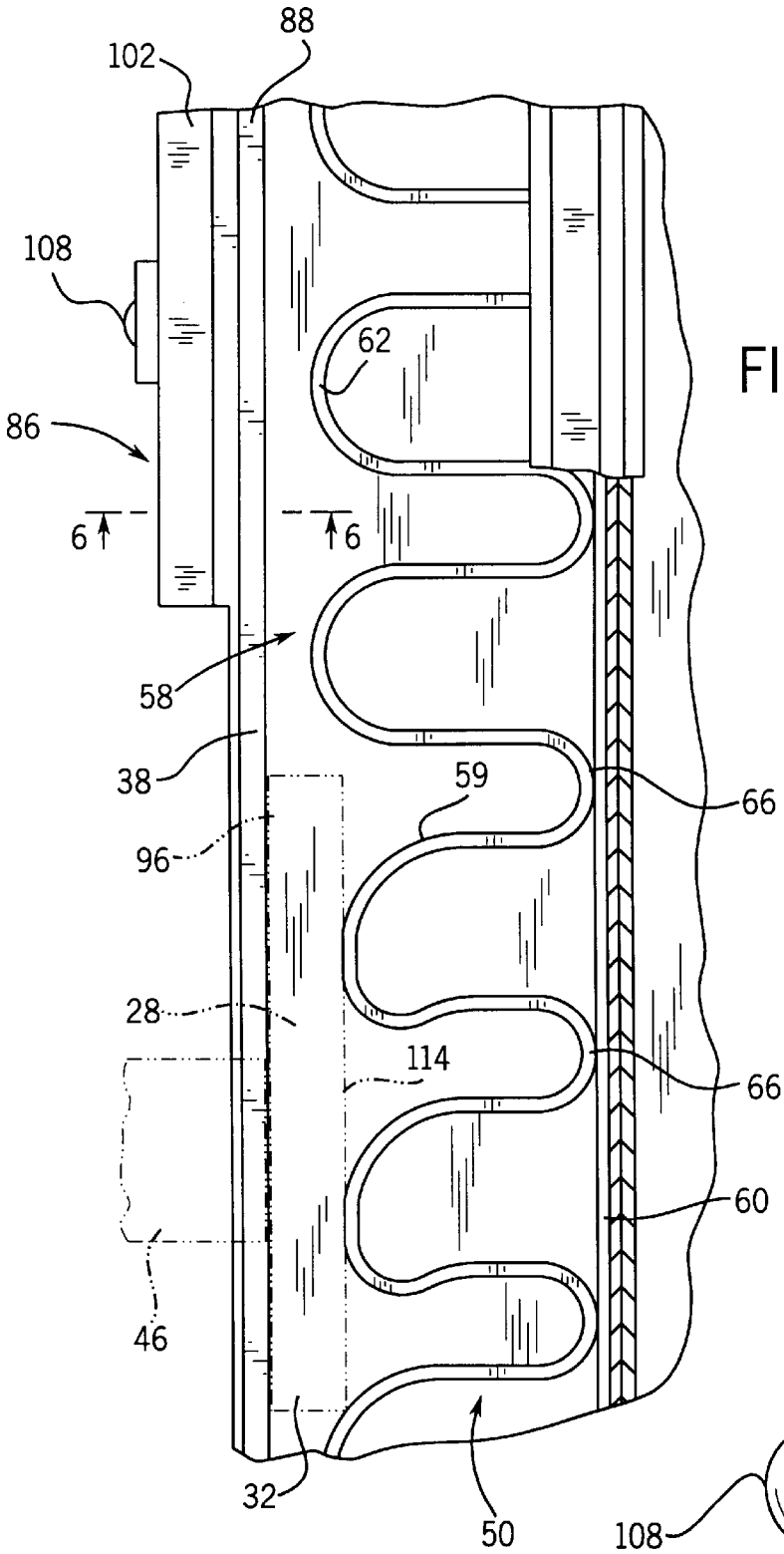
FIG. 5 is a partial top plan view with reference to line 5—5 of FIG. 4, showing the interaction of the biasing belt and an article to which a label is applied.

As can be seen in FIG. 5, the continuous length of material 59 that forms the series of loops 58 includes trough portions 66 that are each fixed to the backing belt 60. The fixed trough portions 66 allow the continuous length of material 59 to retain the desired shape to define the series of loops 58. In the preferred embodiment of the invention, each of the trough portions 66 is fixed to the backing belt 60 by a commercially available adhesive, although other attachment means, such as stitching or the like, may be utilized. Additionally, it is contemplated that the loops 58 could be formed from separated pieces of material fixed at each end to the backing belt 60.

Referring now to FIG. 4, the biasing assembly 48 is mounted to a frame 68 for the labeling station 24 by a series of mounting brackets 70. The mounting brackets 70 are positioned at a slight angle relative to vertical such that the biasing belt 50 is positioned at a slight angle relative to the generally horizontal primary conveyor belt 32. An upper support assembly 72 and a lower support assembly 74 extend along the length of the biasing assembly 48 to support the biasing belt 50 and maintain the operative run of biasing belt 50 in position above the primary conveyor belt 32, as shown in FIG. 4. The lower support assembly 74 is attached to the mounting brackets 70 by conventional connectors 76.

As can be seen in FIG. 4, the primary conveyor belt 32 is supported above the frame 68 by a pair of side supports 78 and 80. The side supports 78 and 80, in turn, are mounted to the frame 68 by a pair of mounting blocks 82 and 84, respectively.

A stationary guide assembly 86, including an upper guide rail 88 and a lower guide rail 90, is positioned adjacent to and above the lateral edge 38 of the primary conveyor belt 32. The stationary guide assembly 86 extends along the entire length of the labeling station 24 such that the stationary guide assembly 86 can support the article 28 as the article 28 moves through the labeling station 24.

The stationary guide assembly 86 includes a series of vertical support brackets 92 spaced along the length of the labeling station 24 to support the upper guide rail 88 and the lower guide rail 90. Each of the support brackets 92 is mounted to the side support 78 by a mounting block 94 and a conventional connector 96. The mounting block 94 provides the required spacing between the support bracket 92 and the lateral edge 38 of the conveyor belt 32.

Each of the support brackets 92 extends vertically upward from the mounting block 94 such that both the upper guide rail 88 and the lower guide rail 90 define vertically aligned outwardly facing article surfaces, which are positioned above the top surface of primary conveyor belt 32. As can be seen in FIG. 4, the upper guide rail 88 and the lower guide rail 90 define vertically aligned outwardly facing engagement surfaces which are positioned directly above the lateral edge 38 of the primary conveyor belt 32, and which engage a first face surface 96 of the article 28 as the article 28 is moved through the labeling station 24 by the primary conveyor belt 32. An extended portion 98 of the side support 78 extends above the primary conveyor belt 32 in alignment with the article engagement surfaces of guide rails 88, 90 such that the extended portion 98 maintains side surface 100 of the article 28 in a vertical position on the primary conveyor belt 32.

Figure 6:
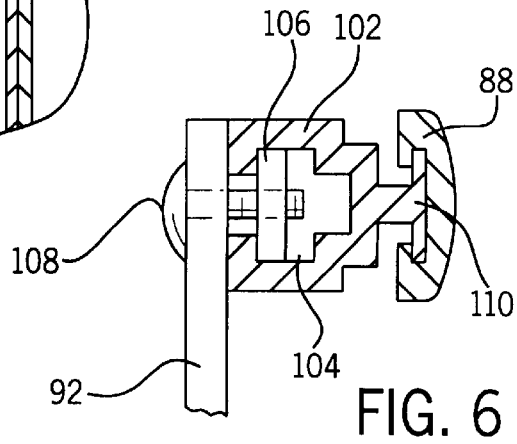
FIG. 6 is a sectional view taken along line 6—6 of FIG. 5.

Referring now to FIG. 6, the upper guide rail 88 is mounted to the support bracket 92 by a mounting block 102. The mounting block 102 includes an internal passage 104 extending throughout its length. A nut 106 is received within passage 104, and engages the threaded shank of a connector 108, which extends through aligned openings in bracket 92 and the wall of mounting block 102 adjacent there to, for securing mounting block 102 to bracket 92. Mounting block 102 includes T-shaped section 110 which is received in a corresponding groove formed in the upper guide rail 88. In the preferred embodiment of the invention, the upper guide rail 88 is formed from a low friction material, such as extruded nylon. Although the mounting arrangement for only the upper guide rail 88 has been discussed in FIG. 6, an identical mounting arrangement is also utilized between bracket 92 and lower guide rail 90.

In operation, labeling station 24 functions as follows to apply a label to an article 28 passing through labeling station 24. As shown in FIG. 2, article 28 initially enters the labeling station 24 on primary conveyor belt 32, moving in the direction shown by arrow 112. As the article 28 is moved by the primary conveyor belt 32, the article 28 comes into contact with the biasing belt 50 of the biasing assembly 48.

As previously discussed and as shown in FIG. 5, the biasing belt 50 is positioned such that the arcuate outer contact surface 62 of each loop 58 is positioned a distance from the upper guide rail 88 and the lower guide rail 90 that is less than the thickness of article 28 between its first face surface 96 and its second face surface is shown at 114. The distance between the biasing belt 50 and the guide rails 88 and 90 is selected based on the thinnest article 28 that will be processed, since the biasing belt 50 can flex to accommodate thicker articles 28.

As the article 28 reaches the biasing belt 50, several of the individual loops 58 of the biasing belt 50 contact the second face surface 114 of the article 28, as shown in FIGS. 4 and 5. Since the thickness of the article 28 is greater than the distance between the arcuate outer contact surface 62 of each loop 58 and the guide rails 88 and 90, the individual loops 58 in contact with the second face surface 114 of the article 28 flex inward as shown in FIG. 5. As the loops 58 flex inward, the loops 58 exert a relatively soft lateral force on the article 28 to press the first face surface 96 of the article 28 into contact with upper guide rail 88, lower guide rail 90, and extended portion 98 of side support 78. As shown in FIG. 4, the article 28 may only contact the lower guide rail 90 depending on the height of the article 28. However, if a taller article 28 is passing through the labeling station 24, the article 28 may also contact the upper guide rail 88. In this manner, the labeling station 24 can accommodate articles 28 having a variety of heights.

Due to its slight downward angle, biasing belt 50 also functions to apply a slight vertically downward force on article 28. This downward force maintains the bottom side surface 100 of article 28 in engagement with primary conveyor belt 32, and also maintains the lower end of first face surface 96 in engagement with side support extended portion 98.

Loops 58 are capable of deforming to varying degrees to accommodate articles 28 having varying thickness. In this manner, the collapsibility of loops 58 enables biasing belt 50 to exert a soft lateral biasing force on all articles 28 regardless of their thickness, to maintain articles 28 in engagement with guide rails 88, 90 and side support extended portion 98 during transport through labeling station 24.

After reaching the biasing belt 50 of the biasing assembly 48, the article 28 continues to move along the primary conveyor belt 32 until the article 28 reaches the labeling units 26. As previously discussed, the labeling units 26 can be operated to either print different types of labels, or can be configured to each print the identical label. If the labeling units 26 each print the identical label, the labeling units 26 alternate in printing and applying a label to the article 28 such that the speed of the labeling station 24 can be increased.

As the article 28 moves in front of one of the print heads 46, a sensor 116 senses the presence of the article 28. As shown in FIG. 4, the sensor 116 is mounted to side support 80 by a mounting flange 118. The mounting flange 118 extends from the side support 80 such that the sensor 116 is positioned above the primary conveyor belt 32 to sense the presence of article 28. Upon detecting the presence of an article, the sensor 116 generates a signal to trigger the application of a label by the print head 46.

As shown in FIGS. 4 and 5, the print head 46 (shown in phantom) is spaced slightly outwardly from the lateral edge 38 of the primary conveyor belt 32. Thus, the print head 46 is also spaced slightly outwardly from the first face surface 96 of the article 28 when the article 28 is pressed into contact with the upper guide rail 88 and the lower guide rail 90 by the biasing belt 50. When the print head 46 applies a label to article 28, the print assembly 46 applies a jet of air to the label to blow the label onto the first face surface 96. Since the loops 58 of the biasing belt 50 exert a positive force to press the first face surface 96 of the article 28 into contact with the stationary guide assembly 86, the first face surface 96 is positioned in a known location relative to the print head 46, regardless of the size of the article being processed. Thus, the reliability and accuracy of the print head 46 is greatly increased, particularly when articles of different size and shape pass in front of the labeling units 26. In prior art systems, the articles 28 simply passed in front of the print head 46 and were not positively held in position, as is done by the biasing belt 50.

As was previously discussed, the motor 56 (FIG. 2) operates to rotate the biasing belt 50 at a speed substantially equal to the operating speed of the primary conveyor belt 32. In this manner, the deformed loops 58 holding the article 28 in contact with the stationary guide assembly 86 continue to press the article 28 into contact with the stationary guide assembly 86 as the article 28 moves along the labeling station 24.

After a label has been applied to the article 28, the article 28 reaches the downstream roller 54 and is then supported by only the guide members 34 and 36. The article 28 then continues to move downstream to the stacker mechanisms 27, as was discussed in the description of FIG. 1.

Although the present invention has been discussed as including a biasing belt 50 in the biasing assembly 48, it is contemplated by the inventor that other types of biasing mechanisms could also be used, such as spring fingers or other types of force applying mechanisms. In any case, it is important that the biasing assembly 48 applies a lateral force to hold the article 28 in contact with the stationary guide assembly 86 such that a first face surface 96 of the article is positioned in the same spaced relation from the print head 46 for each successive article passing through the labeling station 24.

In addition, it should be understood that the stationary guide rails 88, 90 of guide assembly 86 may be replaced with a guide arrangement utilizing rolling elements, or with a guide arrangement having powered elements operating at substantially the same speed as primary conveyor belt 32.

Various alternatives and embodiments are contemplated as being within the scope of the following claims particularly pointing out and distinctly claiming the subject matter regarded as the invention.

I claim:

1. A mechanism for transporting and applying labels to a plurality of articles, the articles each having a first face surface and a second face surface, the mechanism comprising:

at least one labeling unit for applying a label to the article;

a primary conveyor belt for moving the articles past the labeling unit;

a stationary guide extending along the primary conveyor belt for supporting the first face surface of the article, wherein the stationary guide is arranged to contact the article as the article is moved by the primary conveyor belt past the labeling unit; and a movable biasing member positioned to press the first face surface of the article into contact with the stationary guide as the article is moved past the labeling unit by the primary conveyor belt.

2. A mechanism for transporting and applying labels to a plurality of articles, the articles each having a first face surface and a second face surface, the mechanism comprising:

at least one labeling unit for applying a label to the article;

a primary conveyor belt for moving the articles past the labeling unit;

a stationary guide assembly extending along the primary conveyor belt for supporting the first face surface of the article as each article is moved by the primary conveyor belt: and a biasing assembly positioned to press the first face surface of the article into contact with the stationary guide assembly as the article is moved past the labeling unit by the primary conveyor belt, wherein the biasing assembly includes a biasing belt that contacts the second face surface of the article to press the article into contact with the stationary guide assembly.

3. The mechanism of claim 2 wherein the biasing belt is resilient such that the biasing belt can flex away from the stationary guide assembly when the article is positioned between the biasing belt and the stationary guide assembly.

4. The mechanism of claim 3 wherein the biasing belt includes a plurality of loops positioned along the length of the biasing belt, wherein the loops deform upon contact with the second face surface of the article to force the article into contact with the stationary guide assembly.

5. The mechanism of claim 4 wherein the biasing belt includes a continuous backing belt and wherein the plurality of loops are fixed to the backing belt.

6. The mechanism of claim 2 wherein the biasing belt is operated at a speed slightly greater than the speed of the primary conveyor belt.

7. The mechanism of claim 1 wherein the stationary guide assembly includes at least one guide rail extending along the length of the primary conveyor belt and positioned above the primary conveyor belt.

8. The mechanism of claim 7 wherein the stationary guide assembly includes a lower guide rail and an upper guide rail extending along the primary conveyor belt and positioned above the lower guide rail, such that the upper guide rail and the lower guide rail can support the first face surface of the article.

9. The mechanism of claim 7, wherein the labeling unit is arranged so as to apply the label to the article at a location between the primary conveyor belt and the at least one guide rail.

10. The mechanism of claim 1 wherein the stationary guide includes at least one guide rail extending along the primary conveyor belt and positioned above the primary conveyor belt, wherein the rail extends past the labeling unit and includes an upstream portion and a downstream portion, and wherein the movable biasing member maintains the first face surface of the article in engagement with the upstream and downstream portions of the rail as the primary conveyor belt moves the article toward and away from the labeling unit, respectively, and as the labeling unit applies the label to the article.

11. The mechanism of claim 10 wherein the biasing member comprises a biasing belt that contacts the second face surface of the article to press the article into contact with the rail.

12. The mechanism of claim 11 wherein the biasing belt includes a plurality of deformable loops arranged to contact the second face surface of the article to urge the article into contact with the rail.

13. A mechanism for transporting and applying labels to a plurality of articles moving in a single-file, the articles each having a first face surface and an opposed second face surface, the mechanism comprising:

at least one labeling unit for applying a label to each article;

a primary conveyor assembly for moving the plurality of articles past the labeling unit, the labeling unit being positioned above the primary conveyor assembly;

a stationary guide assembly positioned above the primary conveyor assembly for contacting and guiding the first face surface of the article as the article is moved past the labeling unit; and a resilient biasing belt positioned above the primary conveyor, wherein the biasing belt is positioned to contact the second face surface of the article such that the resiliency of the biasing belt exerts a lateral biasing force on the article to press the first face surface into contact with the stationary guide assembly.

14. The mechanism of claim 13 wherein the biasing belt includes a continuous backing belt and a plurality of loops fixed to and extending from the backing belt.

15. The mechanism of claim 14 wherein each of the loops includes an arcuate contact surface spaced from the backing belt, wherein the arcuate contact surface is deflectable toward the backing belt.

16. The mechanism of claim 13 wherein the stationary guide assembly includes a guide rail positioned adjacent to and above a lateral edge defined by the primary conveyor assembly.

17. The mechanism of claim 16 wherein the stationary guide assembly includes an upper guide rail positioned above the first-mentioned guide rail.

18. The mechanism of claim 16 wherein the resilient biasing belt is spaced from the guide rail by a distance less than the width of the article.

19. The mechanism of claim 13 wherein the primary conveyor assembly includes a primary conveyor belt operated to move the article supported thereon past the labeling unit.

20. The mechanism of claim 19 wherein the primary conveyor belt and the biasing belt are operated at substantially the same speed.

21. A method of applying labels to a plurality of articles each having a first face surface and a second face surface, the method comprising the steps of:

receiving the plurality of articles on a primary conveyor assembly having a primary conveyor belt operated to move the articles;

operating a biasing belt that is positioned above the primary conveyor belt and spaced from a stationary guide located above the primary conveyor belt, wherein the biasing belt presses the first face surface of each article into contact with the stationary guide to maintain each article in engagement with the stationary guide as the article is moved by the transport conveyor; and applying a label to the article while the biasing belt presses the article into contact with the stationary guide.

22. The method of claim 21 further comprising the step of operating the primary conveyor belt and the biasing belt at substantially the same speed.

23. The method of claim 21 further comprising the step of positioning the biasing belt a distance less than the width of the article from the stationary guide.

24. A conveyor assembly for transporting a series of articles, each of which includes opposed first and second face surfaces and a lower edge, comprising:

a transport conveyor engageable with the lower edge of each article for moving the article therealong;

a stationary guide arrangement positioned above the transport conveyor; and a movable resilient biasing belt positioned above the transport conveyor and spaced laterally from the stationary guide arrangement, wherein the biasing belt is operable to engage each article and exert a lateral force on the article for maintaining the article in engagement with the guide arrangement as the article is moved by the transport conveyor.

* * * * *